United States Patent [19]

Howell

[11] Patent Number: 4,659,452

[45] Date of Patent: Apr. 21, 1987

[54] MULTI-STAGE HYDROFINING PROCESS

[75] Inventor: Jerald A. Howell, Bartlesville, Okla.

[73] Assignee: Phillips Petroleum, Bartlesville, Okla.

[21] Appl. No.: 866,424

[22] Filed: May 23, 1986

[51] Int. Cl.[4] ..... C10G 65/10; C10G 65/12

[52] U.S. Cl. ..... 208/89; 208/59; 208/61; 208/75; 208/91; 208/107; 208/251 R; 208/251 H

[58] Field of Search ..... 208/57, 89, 61, 58, 208/88, 107, 251 R, 251 H, 253

[56] References Cited

U.S. PATENT DOCUMENTS

| | | | |
|---|---|---|---|
| 3,161,585 | 12/1964 | Gleim et al. | 208/264 |
| 3,362,901 | 1/1968 | Szepe et al. | 208/86 |
| 3,365,389 | 1/1968 | Spars et al. | 208/59 |
| 3,647,677 | 3/1972 | Wolff et al. | 208/48 |
| 3,730,875 | 5/1973 | Gleim et al. | 208/61 |
| 3,947,347 | 3/1976 | Mitchell | 208/251 H |
| 4,005,006 | 1/1977 | Montagna | 208/89 |
| 4,017,380 | 4/1977 | Byler et al. | 208/89 |
| 4,029,571 | 6/1977 | Curtin | 208/107 |
| 4,066,530 | 1/1978 | Aldridge et al. | 208/112 |
| 4,116,820 | 9/1978 | Blytas | 208/251 R |
| 4,210,520 | 7/1980 | Wernicke et al. | 208/57 |
| 4,283,268 | 8/1981 | Rosenthal et al. | 208/89 |
| 4,317,711 | 3/1982 | Yan | 208/425 |
| 4,379,747 | 4/1983 | Yan | 208/251 R |
| 4,427,539 | 1/1984 | Busch et al. | 208/127 |
| 4,447,314 | 5/1984 | Banta | 208/89 |
| 4,457,835 | 7/1984 | Kukes | 208/251 H |
| 4,481,101 | 11/1984 | Yan | 208/107 |
| 4,504,377 | 3/1985 | Shu et al. | 208/251 R |
| 4,534,855 | 8/1985 | Silverman | 502/527 |
| 4,544,479 | 10/1985 | Yan | 208/251 R |
| 4,560,467 | 12/1985 | Stapp | 208/107 |
| 4,564,441 | 1/1986 | Kukes et al. | 208/251 H |
| 4,578,180 | 3/1986 | Kukes et al. | |

*Primary Examiner*—Andrew H. Metz
*Assistant Examiner*—Anthony McFarlane
*Attorney, Agent, or Firm*—K. K. Brandes

[57] ABSTRACT

A two-stage hydrotreating process comprises the steps of (1) contacting a liquid hydrocarbon-containing feed stream, which contains nickel, vanadium and Ramsbottom carbon residue, with hydrogen and a solid inorganic refractory material (preferably alumina) for at least partial removal of Ni and V, and then (2) hydrovisbreaking the intermediate product stream from step (1). Preferably, step (2) is carried out in the presence of at least one decomposable compound of a metal, preferably a molybdenum dithiophosphate.

18 Claims, 1 Drawing Figure

MULTI-STAGE HYDROFINING PROCESS

BACKGROUND OF THE INVENTION

In one aspect, this invention relates to a process for hydrovisbreaking liquid hydrocarbon-containing feed streams so as to produce lower boiling hydrocarbons. In another aspect, this invention relates to a multi-stage process for hydrofining liquid hydrocarbon-containing feed streams, in particular metal-containing heavy oil streams. In a further aspect, this invention relates to a multi-stage hydrofining process employing decomposable transition metal compounds as hydrofining agents.

It is well known to hydrotreat (hydrofine) liquid hydrocarbon-containing feed streams such as heavy oils, which contain undesirable metal and sulfur compounds as impurities and also considerable amounts of cokable materials (referred to as Ramsbottom carbon residue), so as to obtain lower boiling materials having lower molecular weight than the feed hydrocarbons and to remove at least a portion of metal and sulfur impurities and cokable materials from the feed. A specific type of hydrotreating process is heat-soaking, preferably with agitation, in the presence of hydrogen, hereinafter referred to as hydrovisbreaking.

One of the operational problems of such hydrovisbreaking processes is the formation of undesirably high amounts of coke. Coke formation represents loss in hydrocarbonaceous materials and may also necessitate a costly separation step. Therefore, there is an ever present need to develop new, more efficient oil hydrotreating processes and to utilize effective hydrotreating agents designed to reduce coke formation.

SUMMARY OF THE INVENTION

It is an object of this invention to provide a process for hydrotreating (hydrofining) substantially liquid hydrocarbon-containing feed streams, which contain nickel and vanadium and also Ramsbottom carbon residue. It is another object of this invention to reduce the amount of heavies (boiling in excess of 1000° F. at about 1 atm) with minimum coke formation, in a hydrotreating process. It is another object of this invention to provide a process comprising at least two hydrotreating steps. It is a further object of this invention to employ decomposable metal compounds in a multi-stage hydrofining process for reduced coke formation and efficient conversion of high boiling hydrocarbonaceous materials to lower boiling materials. Other objects and advantages will be apparent from the detailed description and the appended claims.

In accordance with this invention, a hydrotreating process comprises the steps of:

(1) contacting (a) a substantially liquid hydrocarbon-containing feed stream, which also contains at least about 3 ppmw (parts by weight per million parts by weight of feed) nickel, at least about 5 ppmw vanadium and at least about 0.5 weight % Ramsbottom carbon residue, simultaneously with (b) a free hydrogen containing gas and (c) a solid, substantially unpromoted inorganic refractory material, under such conditions as to produce an intermediate liquid product stream having a lower content of both nickel and vanadium than the hydrocarbon-containing feed stream; and (2) heating at least a portion of said intermediate liquid product stream in the presence of a free hydrogen containing gas, (preferably in the substantial absence of a solid promoted hydrotreating catalyst or a solid unpromoted inorganic refractory material) under such conditions as to obtain a liquid product containing less Ramsbottom carbon residue and less hydrocarbon material boiling in excess of about 1000° F. (at 1 atm) (referred to as heavies) than said intermediate liquid product stream from step (1).

In one preferred embodiment, the solid inorganic refractory material employed in step (1) is alumina, preferably having a surface area (measured by the BET/$N_2$ method; ASTM D3037) of at least 50 $m^2/g$ and containing less than about 0.5 weight-% of metals belonging to Groups IVB, VB, VIB, VIIB, VIII, IB and IIB of the Periodic Table of Elements (as defined by "College Chemistry", by W. Nebergall et al; Fourth Edition, 1972, D. C. Heath and Company).

In another preferred embodiment, step (2) is carried out in the presence of at least one decomposable compound of at least one metal selected from the group of metals belonging to Groups IVB, VB, VIB, VIIB, VIII, IB and IIB of the Periodic Table. More preferably, this at least one decomposable metal compound is added to the intermediate liquid product stream of step (1). Particularly preferred decomposable metal compounds are those of molybdenum, most preferably molybdenum dithiocarbamates, molybdenum dithiophosphates, and mixtures thereof.

The demetallizing step (1) in the hydrofining process of this invention causes the hydrovisbreaking step (2) to produce less coke than said hydrovisbreaking step without preceding step (1). This effect is surprisingly enhanced when a decomposable metal compound is present in step (2).

DETAILED DESCRIPTION OF THE INVENTION

Figure 1:
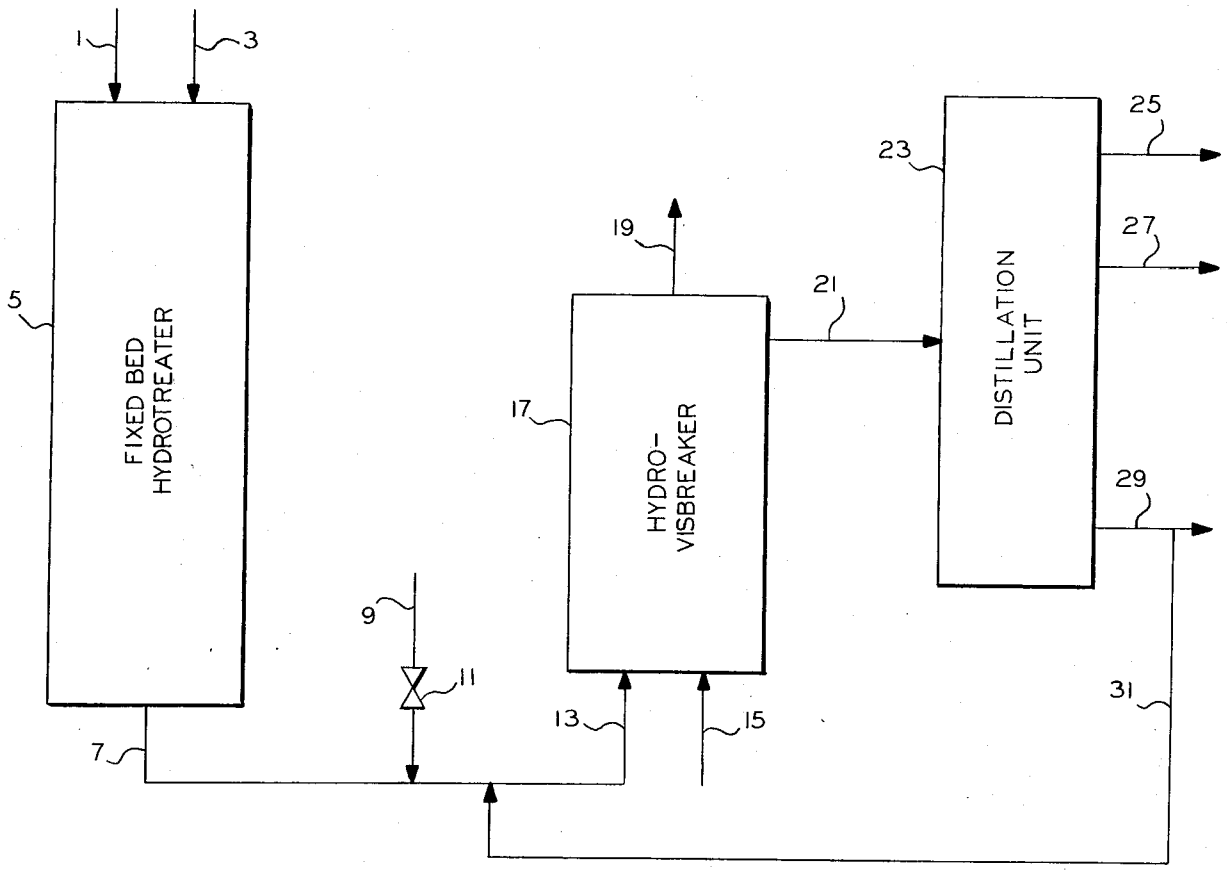
FIG. 1 is a schematic diagram of a preferred embodiment of the multi-step hydrotreating process of this invention.

Any hydrocarbon-containing feed stream that is substantially liquid at the contacting conditions of the first step of the process of this invention and contains at least about 0.5 weight-% Ramsbottom carbon residue (determined according to ASTM D524), at least about 3 ppmw nickel and at least about 5 ppmw vanadium can be processed in the process of this invention. Suitable hydrocarbon-containing feed streams include crude oil, petroleum products, coal pyrolyzates, products from extraction and/or liquefaction of coal and lignite, products from tar sands, shale oil, products from shale oil and similar products. Preferred hydrocarbon-containing feed streams of this invention include full range (untopped) crudes, topped crudes having a boiling range in excess of about 343° C. (650° F.) and residua. These materials will generally contain high concentrations of Ramsbottom carbon residue, metals (Ni, V), sulfur and nitrogen. Nickel and vanadium are generally present as compounds, in particular metal-porphyrin compounds.

Preferably the Ramsbottom carbon residue content of the hydrocarbon feed stream exceeds about 1 weight-% and more preferably is in the range of about 2–30 weight-%. Preferably the hydrocarbon-containing feed stream also contains about 3–500 ppmw nickel (parts by weight of Ni per million parts by weight of feed) and about 5–1000 ppmw vanadium, more preferably about 5–300 ppmw nickel and about 10–500 ppmw vanadium. Generally, the feed stream also contains about 0.2–6 weight-% sulfur, about 0.1–3 weight-% nitrogen and 1–99 weight-% of materials boiling in excess of about 1000° F. under atmospheric pressure conditions. Preferably, the $API_{60}$ gravity of the feed ranges from about 4 to about 30, and the amount of heavies boiling above 1000° F. (at 1 atm) is in the range of from about 5 to about 99 weight-%.

The free hydrogen containing gas used in both steps of the hydrotreating process of this invention can be substantially pure hydrogen gas, or can be a mixture of hydrogen with at least one other gas such as nitrogen, helium, methane, ethane, carbon monoxide, hydrogen sulfide and the like. At present, substantially pure hydrogen gas is preferred.

Hydrotreating step (1) can be carried out in any apparatus whereby an intimate contact of the solid inorganic refractory material (c) with said hydrocarbon-containing feed stream (a) and a free hydrogen containing gas (b) is achieved, under such conditions as to produce a hydrocarbon-containing intermediate liquid product stream having reduced levels of nickel and vanadium. Generally, lower levels of sulfur, nitrogen and Ramsbottom carbon residue and a higher value of $API_{60}$ gravity are also attained in hydrotreating step (1). This hydrotreating step can be carried out using a fixed bed or a fluidized bed or a moving bed of the inorganic refractory material or an agitated slurry of the inorganic refractory material in the oil feed. The hydrotreating step can be carried out as a batch process or, preferably, as a continuous process. Preferably, a fixed bed of the inorganic refractory material is used in hydrotreating step (1) so as to eliminate the need of a step for separating the liquid intermediate product from the refractory inorganic material.

Any solid inorganic refractory material that causes a reduction of the concentration of nickel and vanadium in the hydrocarbon-containing feed stream can be employed in hydrotreating step (1). Non-limiting examples of inorganic refractory materials that can be used in step (1) are alumina, silica, magnesia, metal silicates, metal aluminates, aluminosilicates (e.g., clays), aluminum phosphate, and the like, and mixtures thereof. Alternating layers of different refractory materials can be used. The presently preferred inorganic refractory material is alumina, which more preferably has a surface area (BET/$N_2$; ASTM D3037) in the range of from about 10 to about 500 $m^2/g$, most preferably from about 50 to about 300 $m^2/g$), and a pore volume (determined by mercury intrusion at a pressure of about 15 Kpsig) in the range of from about 0.2 to about 2.0 cc/g.

The solid, substantially unpromoted inorganic refractory material is substantially free of metals belonging to Groups IVB, VB, VIB, VIIB, VIII, IB and IIB of the Periodic Table, i.e. the refractory material contains these metals at a combined level of less than about 0.5 weight-%, more preferably less than about 0.3 weight-%.

Any suitable quantities of the free hydrogen containing gas can by employed in the step (1) of this invention. The quantity of hydrogen gas used to contact the hydrocarbon-containing feed stock, either in a continuous or a batch process, will generally be in the range of about 100 to about 20,000 standard cubic feet $H_2$ per barrel of the hydrocarbon-containing feed stream and will more preferably be in the range of about 500 to about 6,000 standard cubic feet $H_2$ per barrel of the hydrocarbon-containing feed stream.

Any suitable reaction time, i.e., time of contact between the solid refractory inorganic material, the hydrocarbon-containing feed stream and the hydrogen containing gas, can be utilized in step (1). In general, the reaction time will range from about 0.05 hours to about 10 hours. Preferably, the reaction time will range from about 0.4 to about 5 hours. Thus, the flow rate of the hydrocarbon-containing feed stream should be such that the time required for the passage of the mixture through the reactor (residence time) will be in the range of from about 0.05 to about 10 hours, preferably in the range of about 0.4 to about 5 hours. In a continuous fixed bed operation, this generally requires a liquid hourly space velocity (LHSV) in the range of about 0.10 to about 20 cc of feed per cc of catalyst per hour, preferably from about 0.2 to about 2.5 cc/cc/hr.

The hydrotreating step (1) of the present invention can be carried out at any suitable temperature. The temperature will generally be in the range of about 250° C. to about 550° C. and will preferably be in the range of about 350° C. to about 450° C. Higher temperatures do improve the removal of metals, but temperatures which will have adverse effects on the hydrocarbon-containing feed stream, such as excessive coking, will usually be avoided. Also, economic considerations will usually be taken into account in selecting the operating temperature.

Any suitable pressure can be utilized in the hydrotreating step (1). The reaction pressure will generally be in the range of about atmospheric pressure (0 psig) to up to about 5,000 psig. Preferably, the pressure will be in the range of about 100 to about 3000 psig. Higher pressures tend to reduce coke formation but operating at high pressure may be undesirable for safety and economic reasons.

Preferably, hydrotreating step (1) is conducted at such conditions as to reduce the amount of nickel and vanadium present in the hydrocarbon-containing feed stream by at least about 30%, more preferably by at least 50%. These metals (Ni, V) are preferably trapped by the solid inorganic refractory material, either by deposition on the surface (usually in combination with sulfur compounds and coke) and/or in the pores of the refractory material.

In general, the inorganic refractory material is utilized for demetallization in step (1) until a satisfactory level of metals (Ni, V) removal is no longer achieved. Deactivation generally results from the coating of the inorganic refractory material with coke and metals removed from the feed. It is possible to remove the metals from the refractory material, but it is generally comtemplated that once the removal of metals falls below a desired level, the spent (deactivated) refractory material will simply be replaced by fresh catalyst.

The time in which the refractory material of this invention will maintain its activity for removal of metals will depend upon the metals concentration in the hydrocarbon-containing feed streams being treated. Generally the inorganic refractory material can be used for a period of time long enough to accumulate about 50–200 wt. % of metals, mostly Ni and V, based on the initial weight of the inorganic refractory material, from the hydrocarbon containing feed. In other words, the weight of the spent inorganic refractory material will be about 50–200% higher than the weight of the fresh inorganic refractory material.

The intermediate hydrocarbon-containing product stream produced in hydrofining step (1) generally contains from about 2 to about 100 ppmw Ni and from about 4 to about 200 ppmw V, preferably from about 2 to about 60 ppmw Ni and from about 4 to about 100 ppmw V.

It is within the scope of this invention, even though presently not preferred, to carry out hydrotreating step (1) in the presence of dissolved or colloidally dispersed decomposable compounds of metals belonging to Groups IVB, VB, VIB, VIIB, VIII, IB and IIB. Examples of such added decomposable metal compounds are essentially the same as those used in the preferred mode of step (2) and are described below. The concentration of metals from these decomposable metal compounds, when used in step (1), generally range from about 1 to about 200 ppm added metal, preferably about 2 to 100 ppm added metal (preferably Mo).

The intermediate product stream of step (1) is heated (heat-soaked) in the hydrovisbreaking step (2) of this invention. The hydrovisbreaking step (2) of the process of this invention is in no way limited to the use of any particular type of operation or apparatus. The term "feed stream" refers to both continuous and batch operation.

If step (2) is carried out as a continuous operation (presently preferred), the intermediate product stream from step (1) is passed concurrently with a stream of free hydrogen-containing gas into the bottom portion of a reactor, which is preferably equipped with heating means and also mechanical agitating or static mixing means, so as to provide intimate contact of the intermediate process stream and hydrogen at an elevated temperature. The gaseous and liquid products generally exit through outlets located in the top portion of the reactor.

If step (2) is carried out as a batch operation, the liquid intermediate product stream from step (1) and a free hydrogen-containing gas are introduced concurrently, or sequentially in any order, into a reactor equipped with heating means and agitating or static mixing means. The reactor is then heated, generally at an elevated pressure. After the batch hydrovisbreaking operation is completed, the entire reactor contents are generally drained into another vessel for further separation of the final product components in any conventional manner.

Even though it may be possible to carry out hydrovisbreaking step (2) in the presence of inorganic solid materials such as either unpromoted or promoted inorganic refractory materials (e.g., $Al_2O_3$, $SiO_2$, $AlPO_4$ and the like, $Ni/Mo/Al_2O_3$, $Co/Mo/Al_2O_3$ and the like), it is highly preferred that these solid materials are substantially absent in step (2) so as to minimize operational problems (such as clogging of the exit line by solid materials) and to facilitate the subsequent separation of the product into various fractions (without the need of a solid-liquid separation step) and the recycling of heavy product fractions (being free of dispersed solids). It is a particular advantage of the hydrotreating process of this invention that no solid inorganic sorbent or solid inorganic hydrotreating material is needed in the hydrovisbreaking step.

It is preferred to carry out hydrovisbreaking step (2) in the presence of at least one added decomposable compound of at least one metal belonging to one of Groups IVB, VB, VIB, VIIB, VIII, IB and IIB of the Periodic Table of Elements. Non-limiting examples of such decomposable metal compounds include carbonyls, acetylacetonates, carboxylates (e.g., naphthenate, octanoate), heteropolyacids, mercaptides, xanthates, dithiophosphates, dithiocarbamates and the like of metals such as zirconium, vanadium, chromium, molybdenum, tungsten, manganese, rhenium, cobalt, nickel, copper and zinc, and mixtures thereof. Presently preferred decomposable metal compounds which are soluble in the intermediate product stream include those of molybdenum, more preferably molybdenum dithiophosphates and molybdenum dithiocarbamates, and mixtures thereof. The decomposable metal compound can be added as a solution in a suitable solvent.

Any suitable molybdenum dithiophosphate compounds may be used as the molybdenum additive. Generic formulas of suitable molybdenum dithiophosphates are:

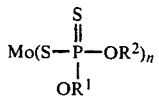

(1)

wherein n=3,4,5,6; $R^1$ and $R^2$ are either independently selected from H, alkyl groups having 1–20 carbon atoms, cycloalkyl or alkylcycloalkyl groups having 3–22 carbon atoms and aryl, alkylaryl or cycloalkylaryl groups having 6–25 carbon atoms; or $R^1$ and $R^2$ are combined in one alkylene group of the structure

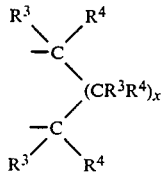

with $R^3$ and $R^4$ being independently selected from H, alkyl, cycloalkyl, alkylcycloalkyl and aryl, alkylaryl and cycloalkylaryl groups as defined above, and x ranging from 1 to 10;

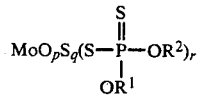

(2)

wherein p=0,1,2,; q=0,1,2; (p+q)=1,2;
r=1,2,3,4 for (p+q)=1 and
r=1,2 for (p+q)=2;

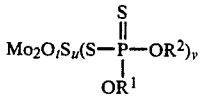

(3)

wherein t=0,1,2,3,4; u=0,1,2,3,4;
(t+u)=1,2,3,4
v=4,6,8,10 for (t+u)=1; v=2,4,6,8 for (t+u)=2;
v=2,4,6 for (t+u)=3, v=2,4 for (t+u)=4.

Sulfurized oxomolybdenum(V) O,O'-di(2-ethylhexyl)-phosphorodithioate of the formula $Mo_2O_2S_2[S_2P(OC_8H_{17})_2]_2$ is particularly preferred.

Any suitable molybdenum dithiocarbamate compound may be used in the molybdenum additive. Generic formulas of suitable molybdenum (III), (IV), (V) and (VI) dithiocarbamates are:

$$[Mo(S-\overset{\overset{\displaystyle S}{\|}}{C}-NR^1R^2)_n]_m, \quad (4)$$

wherein n=3,4,5,6; m=1,2; $R^1$ and $R^2$ are either independently selected from H, alkyl groups having 1–20 carbon atoms, cycloalkyl groups having 3–22 carbon atoms and aryl groups having 6–25 carbon atoms; or $R^1$ and $R^2$ are combined in one alkylene group of the structure

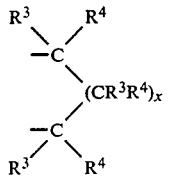

with $R^3$ and $R^4$ being independently selected from H, alkyl, cycloalkyl and aryl groups as defined above, and x ranging from 1 to 10.

$$MoO_pS_q(S-\overset{\overset{\displaystyle S}{\|}}{C}-NR^1R^2)_r, \quad (5)$$

wherein p=0,1,2; q=0,1,2; (p+q)=1,2;
r=1,2,3,4 for (p+q)=1 and
r=1,2 for (p+q)=2;

$$Mo_2O_tS_u(S-\overset{\overset{\displaystyle S}{\|}}{C}-NR^1R^2)_v, \quad (6)$$

wherein t=0,1,2,3,4; u=0,1,2,3,4;
(t+u)=1,2,3,4
v=4,6,8,10 for (t+u)=1; v=2,4,6,8 for (t+u)=2;
v=2,4,6 for (t=u)=3, v=2,4 for (t+u)=4.

Molybdenum(V) di(tridecyl)dithiocarbamate is particularly preferred.

Any suitable concentration of the decomposable metal compound can be used in step (2). Generally the concentration of the metal from the added decomposable metal compound should be at least about 50 ppmw metal (preferably Mo), i.e., 50 parts or more of metal (preferably Mo) per million parts of intermediate product stream, and should preferably be in the range of from about 50 to about 500 ppmw metal (more preferably Mo).

The decomposable metal compound can be added in any suitable manner, continuously or intermittently, and at any suitable location. Generally the decomposable metal compound, optionally dissolved in a suitable solent, is injected into the conduit that transports the intermediate product stream from step (1) into the reactor of step (2). However, the decomposable metal compound can also be added directly to the hydrovisbreaking reactor of step (2).

Any suitable reaction time in the hydrovisbreaking step (2) of this invention may be utilized. In general, the reaction time (i.e., the time of contact between the intermediate product stream, hydrogen containing gas and, optionally, the decomposable metal compound) will range from about 0.01 hours to about 20 hours. Preferably, the reaction time will range from about 0.1 to about 5 hours and more preferably from about 0.25 to about 3 hours. Thus, for a continuous process, the flow rate of the intermediate hydrocarbon-containing stream should be such that the time required for the passage of the mixture through the reactor (residence time) will be about 0.01–20 hours, preferably 0.1–5 hours, more preferably about 0.25–3 hours. In a batch process, the intermediate hydrocarbon-containing stream will remain in the reactor for about 0.01–10 hours, preferably about 0.1–5 hours and more preferably about 0.25–3 hours.

The hydrovisbreaking step (2) of this invention can be carried out at any suitable temperature. The temperature will generally be in the range of about 250° C. to about 550° C. and will preferably be in the range of about 350° C. to about 480° C. Higher temperatures do improve the removal of impurities, but such temperatures may have adverse effects on coke formation. Also, economic consideration will have to be taken into consideration in the selection of the reaction temperature.

Any suitable pressure of hydrogen can be utilized in the hydrovisbreaking step (2) of this invention. The reaction pressure will generally be in the range of about atmospheric (0 psig) to about 10,000 psig. Preferably, the hydrogen pressure will be in the range of about 500 to about 3,000 psig. Higher hydrogen pressures tend to reduce coke formation but operation at high pressure may have adverse economic consequences.

The gaseous, liquid and solid products of the hydrofining (hydrovisbreaking) step (2) of this invention can be withdrawn from the contacting reactor and separated from each other by any conventional separating means. Also, the fractionation of the liquid hydrocarbon-containing product having reduced Ramsbottom carbon residue into fractions boiling in different temperature ranges can be carried out by any conventional distillation means, either under atmospheric or vacuum conditions. At least a portion of the heavy fraction can be recycled to the hydrovisbreaking reactor.

Preferably, at least a portion of the liquid hydrocarbon-containing product exiting from the hydrovisbreaking reaction of step (2) is treated in at least one additional hydrotreating process, more preferably carried out in a fixed bed reactor containing a suitable solid hydrofining catalyst (such as $Co/Mo/Al_2O_3$ or $Ni/Mo/Al_2O_3$ and the like) so as to reduce the amounts of remaining impurities (Ni, V, S, N, coke precursors) contained in said effluent and is then treated in a catalytic cracking process (e.g., a FCC process employing zeolite-containing catalysts) under such conditions so as to produce gasoline, distillate fuels and other useful products. It is, however, within the scope of this invention to catalytically crack (e.g., in the presence of zeolite or clay catalysts) at least a portion of said liquid hydrovisbroken product without such an additional prior hydrotreating process.

A preferred embodiment of this invention will now be described in conjunction with the drawing in FIG. 1, which is a schematic representation of the preferred process of this invention. Hot oil feed stream 1 and hydrogen gas containing stream 3 are passed through heated hydrotreater 5 containing a fixed bed of solid inorganic refractory material for removal of at least a portion (preferably a major portion) of nickel and vanadium from the oil. The intermediate product stream 7 having reduced concentrations of nickel and vanadium (and also generally reduced concentrations of S, N, Ramsbottom carbon residue and of materials boiling in excess of 1000° F.) exits at the bottom of reactor 5. Preferably a stream of decomposable metal compound 9 is added through open valve 11, and the combined stream 13 is charged with a hydrogen containing gas stream 15 to the hydrovisbreaking reactor 17 (being equipped with heating and internal agitating means such as a mechanical stirrer). If no decomposable metal compound is to be added to the intermediate product stream, valve 11 is closed. Gaseous products and unconsumed hydrogen gas exit through line 19. The liquid products exit through line 21 near the top of hydrovisbreaker 17 and are separated into several liquid product streams (25, 27, 29 and, optionally, additional streams) by fractionation in distillation unit 23. A portion of the heavy product stream 29 can be recycled via line 31 into the hydrovisbreaker 17.

The following examples are presented in further illustration of the invention.

EXAMPLE I

In this example the experimental setup for batch-type hydrovisbreaking of heavy oils (simulating step 2) is described. About 100 grams of a heavy oil (and, optionally, appropriate amounts of a decomposable compound) were added to a 300 cc stirred autoclave (Autoclave Engineers, Inc., Erie, PA), which was preheated to about 200° F. The unit was sealed, alternately pressured with $H_2$ and vented so as to eliminate air, and finally pressured with $H_2$ to the desired starting pressure (1000–1400 psig). Stirring at about 1000 r.p.m. and rapid heating up to the test temperature about 800° F. was carried out. During the test run, hydrogen gas was added so as to maintain a constant pressure of about 1900–2500 psig at the final test temperature.

After heating at about 800° F. for about 60 minutes, the unit was cooled as quickly as possible, depressured and opened. The liquid product was collected and analyzed. The amount of dispersed coke particles (collected by filtration through a 0.45 μm membrane filter and weighing) and the amount of the fraction boiling above 1000° F. were determined.

Two heavy oil feeds were used. In control runs, a topped (650° F.+) Hondo crude oil was employed as feed (A). The feed B for invention runs was a 650° F.+ Hondo topped crude that had been hydrotreated in a fixed bed reactor containing alumina (having an average pore diameter of 170 Å) at 780° F., a liquid hourly space velocity of 1.0 cc/cc catalyst μm and a hydrogen pressure of 2250 psig. Properties of both feed oils are summarized in Table I.

TABLE I

| Feed | A (Control) | B[1] (Invention) |
|---|---|---|
| Pentane Insolubles, wt. % | 19.34 | 7.42 |
| Ramsbottom Carbon, wt. % | 11.45 | 9.03 |
| $API_{60}$ Gravity | 8.9 | 14.1 |
| Viscosity, centistoke 80° C. | 1561 | 79.7 |
| Sulfur, wt % | 5.78 | 3.42 |
| Vanadium, ppmw[2] | 386 | 65.2 |
| Nickel, ppmw[2] | 163 | 46.2 |
| 1000 F.+ content, wt % | 63.97 | 46.15 |

[1]Feed A which had been hydrotreated in a fixed bed reactor containing $Al_2O_3$ for partial removal of V, Ni, as described above

[2]determined by plasma emission analysis

EXAMPLE II

This example illustrates the results of hydrovisbreaking tests in accordance with the procedure outlined in Example I employing the two feeds A and B and, optionally, decomposable Mo compounds. Test results are summarized in Table II.

TABLE II

| | Run | | | | | |
|---|---|---|---|---|---|---|
| | 1 (Control) | 2 (Invention) | 3 (Control) | 4 (Invention) | 5 (Control) | 6 (Invention) |
| Oil Feed | A | B | A | B | A | B |
| Additive | None | None | Molyvan L[1] | Molyvan L[1] | Molyvan L[1] | Molyvan L[1] |
| Mo Concentration (ppm) | 0 | 0 | 25 | 25 | 57 | 58 |
| Reaction temp. (°F.) | 800 | 800 | 800 | 800 | 800 | 800 |
| Reaction Pressure (psig) | 2,430 | 2,260 | 1,850 | 1,920 | 2,280 | 2,470 |
| Reaction time (Min.) | 60 | 60 | 60 | 60 | 60 | 60 |
| % Conv. of 1000F+, Based on Test Feed Used in Run | 71 | 62 | 72.7 | 45.8 | 77 | 55.4 |
| % Conv. of 1000F+ Fraction Based on Feed A | 71 | 74 | 72.7 | 62 | 77 | 68.8 |
| Coke Formation (Wt %), Based on Test Feed Used in Run | 7.7 | 2.8 | 5.0 | 1.5 | 3.3 | 0.5 |
| Selectivity to Coke (Wt %) Based on Feed A[2] | 10.8 | 3.8 | 6.9 | 2.4 | 4.3 | 0.7 |

[1]A mixture of about 80 weight % of a sulfided Mo(V) dithiophosphate of the formula $Mo_2S_2O_2[PS_2(OR)_2]_2$, wherein R is the 2-ethylhexyl group and 20 weight % of an aromatic oil (specific gravity: 0.963; viscosity at 210° F.: 38.4 SUS); marketed by R. T. Vanderbilt Company, Norwalk, CT.
[2]Coke Formation ÷ Conversion of 1000 F+, based on A The results summarized in Table II show:

(a) Selectiviety to coke (coke formation÷conversion, based on feed A) was always significantly lower when feed A had previously been hydrotreated in a fixed bed of alumina (so as to make "intermediate" feed B).

(b) Reduction of selectivity to coke was greater when Molyvan L was added, at a level of 57–58 ppm Mo, to the test feed: the %-reduction of selectivity to coke in run 2 vs. run 1 was 65%; the %-reduction of selectivity to coke in run 4 vs. run 3 was also 65%; but the %-reduction of selectivity to coke in run 6 vs. run 5 was 84%.

Based on these data, it is concluded that the preferred mode of the hydrovisbreaking step (2) of this invention is carried out in the presence of a decomposable Mo or compound added at a level of 50 ppm Mo higher.

EXAMPLE III

This example illustrates the effect of the degree of metal removed in step (1) (hydrotreatment in a reactor with a fixed bed $Al_2O_3$) on the selectivity to formed coke in hydrovisbreaking step (2). Pertinent process and product parameters are summarized in Table III. The initial feed in runs 7–12 was feed A (see Example I). No decomposable Mo compounds were employed.

TABLE III

| | Run | | | | | |
|---|---|---|---|---|---|---|
| | 7 (Control) | 8 (Invention) | 9 (Invention) | 10 (Invention) | 11 (Invention) | 12 (Invention) |
| Hydrotreating Step (1): | | | | | | |
| Reaction Temperature (°F.) | None | 700 | 721 | 742 | 760 | 780 |
| Reaction Pressure (psig) | None | 2250 | 2250 | 2250 | 2250 | 2250 |
| LHSV (cc/cc/hr) | None | 0.81 | 0.82 | 0.81 | 0.86 | 1.0 |
| % Conversion of 1000° F.+ | None | 10.1 | 14.9 | 28.6 | 28.7 | 30.1 |
| % Conversion of Ramsbottom C | None | 15.5 | 22.5 | 25.6 | 31.1 | 28.8 |
| % Removal of Ni and V | None | 37.9 | 58.4 | 67.6 | 75.5 | 75.2 |
| Hydrovisbreaking Step (2): | | | | | | |
| Reaction Temperature (°F.) | 800 | 800 | 800 | 800 | 800 | 800 |
| Reaction Pressure (psig) | 2340 | 2420 | 2420 | 2370 | 2300 | 2460 |
| Reaction Time (minutes) | 60 | 60 | 60 | 60 | 60 | 60 |
| % Convers. of 1000F+ Fraction | 82.7 | 74.2 | — | 78.5 | 76.5 | 73.6 |
| Coke Formation, Wt % of Freed | 8.0 | 6.1 | 5.4 | 4.9 | 3.9 | 2.6 |
| % Selectivity to Coke | 9.7 | 8.2 | — | 6.2 | 5.1 | 3.5 |

Data in Table III clearly show that a higher degree of removal of Ni and V in hydrotreating step (1) resulted in lower selectivity to undesirable coke in the subsequent hydrovisbreaking step (2).

Reasonable variations and modification are possible within the scope of the disclosure and the appended claims to the invention.

We claim:

1. A hydrotreating process comprising the steps of:
(1) contacting (a) a substantially liquid hydrocarbon-containing feed stream, which also contains at least about 3 ppmw nickel, at least about 5 ppmw vanadium and at least about 0.5 weight-% Ramsbottom carbon residue, simultaneously with (b) a free hydrogen containing gas and (c) a fixed bed containing a solid, substantially unpromoted inorganic refractory material selected from the group consisting of alumina, silica, magnesia, metal silicates, metal aluminates, aluminosilicates, aluminum phosphate and mixtures thereof, under such contacting conditions as to produce an intermediate liquid product stream having a lower content of nickel and vanadium than said hydrocarbon-containing feed stream; and
(2) heating at least a portion of said intermediate liquid product stream in the presence of a free hydrogen containing gas under hydrovisbreaking conditions as to obtain a liquid product containing less Ramsbottom carbon residue and less hydrocarbon material boiling in excess of about 1000° F. at 1 atm than said intermediate liquid product stream obtained in step (1).

2. A process in accordance with claim 1, wherein said substantially liquid hydrocarbon-containing feed stream contains about 3–500 ppmw nickel and about 5–1,000 ppmw vanadium.

3. A process in accordance with claim 2, wherein said substantially liquid hydrocarbon-containing feed stream also contains about 2–30 weight-% Ramsbottom carbon residue and about 5–90 weight-% of hydrocarbons boiling in excess of about 1000° F. at 1 atm.

4. A process in accordance with claim 1, wherein said solid, substantially unpromoted inorganic refractory material used in step (1) is alumina.

5. A process in accordance with claim 4, wherein said alumina has a surface area in the range of from about 50 to about 300 $m^2/g$;

6. A process in accordance with claim 5, wherein said alumina contains less than about 0.5 weight-% of metals belonging to Groups IVB, VB, VIIB, VIII, IB and IIB of the Periodic Table of Elements.

7. A process in accordance with claim 1 wherein said contacting conditions in step (1) comprise a hydrogen feed ratio in the range of from about 100 to about 20,000 standard cubic feet of $H_2$ per barrel of hydrocarbon-containing feed, a reaction time in the range of from about 0.05 to about 10 hours, a reaction temperature in the range of from about 250° to about 550° C., and a reaction pressure in the range of from about 0 psig to about 10,000 psig.

8. A process in accordance with claim 1 wherein said contacting conditions in step (1) comprise a hydrogen feed ratio in the range of from about 500 to about 6,000 standard cubic feet of $H_2$ per barrel of hydrocarbon-containing feed, a time of contact between (a), (b) and (c) in the range of from about 0.4 to about 5 hours, a reaction temperature in the range of from about 350° to about 450° F. and a reaction pressure in the range of from about 100 psig to about 3,000 psig.

9. A process in accordance with claim 1, wherein the intermediate liquid product stream produced in step (1) contains from about 2 to about 100 ppmw nickel and from about 4 to about 200 ppmw vanadium.

10. A process in accordance with claim 1, wherein said hydrovisbreaking conditions in heating step (2) comprise a temperature in the range of from about 250° to about 550° C., a hydrogen pressure in the range of from about 0 to about 10,000 psig and a reaction time in the range of from about 0.01 to about 20 hours.

11. A process in accordance with claim 1, wherein said hydrovisbreaking conditions in heating step (2) comprise a temperature in the range of from about 350° to about 480° C., a hydrogen pressure in the range of from about 500 to about 3,000 psig and a reaction time in the range of from about 0.1 to about 5 hours.

12. A process in accordance with claim 1, wherein said heating step (2) is carried out with agitation.

13. A process in accordance with claim 1, wherein said heating step (2) is carried out in the substantial absence of inorganic solid materials.

14. A process in accordance with claim 1, wherein said heating step (2) is carried out in the presence of at least one added decomposable compound of at least one metal belonging to at least one of Group IVB, VB, VIB, VIIB, VIII, IB and IIB of the Periodic Table of Elements.

15. A process in accordance with claim 14, wherein the concentration of said at least one metal from said at least one added decomposable compound is at leat 50 ppmw metal, and said metal is molybdenum.

16. A process in accordance with claim 15, wherein molybdenum is present at a concentration in the range of from about 50 to about 500 ppmw molybdenum.

17. A process in accordance with claim 15, wherein the at least one added decomposable compound is selected from the group consisting of molybdenum dithiophosphates and molybdenum dithiocarbamates.

18. A process in accordance with claim 17, wherein said at least one added decomposable compound is a sulfided molybdenum(V) dithiophosphate, having the formula $Mo_2S_2O_2[PS_2(OR)_2]_2$, wherein R is the 2-ethylhexyl group.

* * * * *